US009278543B2

(12) United States Patent
Adachi et al.

(10) Patent No.: US 9,278,543 B2
(45) Date of Patent: Mar. 8, 2016

(54) INKJET RECORDING APPARATUS

(71) Applicant: CANON KABUSHIKI KAISHA, Tokyo (JP)

(72) Inventors: Eiichi Adachi, Kawasaki (JP); Shigeru Watanabe, Yokohama (JP); Naoaki Wada, Yokohama (JP); Kouhei Tokuda, Tokyo (JP); Tsutomu Obata, Tokyo (JP); Hiroyuki Matsunaka, Hachioji (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/809,628

(22) Filed: Jul. 27, 2015

(65) Prior Publication Data

US 2016/0023469 A1 Jan. 28, 2016

(30) Foreign Application Priority Data

Jul. 28, 2014 (JP) ..... 2014-152909

(51) Int. Cl.
*B41J 29/393* (2006.01)
*B41J 2/175* (2006.01)

(52) U.S. Cl.
CPC ..... *B41J 2/17566* (2013.01)

(58) Field of Classification Search
CPC .. B41J 2/2142; B41J 2029/3935; B41J 2/125; B41J 2/0451; B41J 11/0095; B41J 2/14145; B41J 2/1433
See application file for complete search history.

(56) References Cited

U.S. PATENT DOCUMENTS 7,419,233 B2 * 9/2008 Katayama ..... B41J 2/17566 347/7
8,641,179 B2 * 2/2014 Kuribayashi ..... B41J 2/175 347/19
9,004,626 B2 * 4/2015 Tsuchiya ..... B41J 2/175 347/19

FOREIGN PATENT DOCUMENTS

JP 2007-237552 A 9/2007

* cited by examiner

*Primary Examiner* — Lamson Nguyen
(74) *Attorney, Agent, or Firm* — Canon USA Inc. IP Division

(57) ABSTRACT

A first ink tank, and a second ink tank including a first chamber having an ink inlet port and a second chamber having a sensing unit are provided. The ink inlet port is provided at a position so that a volume of the second ink tank above a second height does not become smaller than an amount of ink volume change in the second chamber when the ink volume is changed from a first height which is a height of the ink surface when a minimum volume of ink is in the second ink tank under normal usage to a second height which is a height of the ink inlet port.

10 Claims, 13 Drawing Sheets

INKJET RECORDING APPARATUS

BACKGROUND OF THE INVENTION

1. Field of the Invention

This disclosure relates to an inkjet recording apparatus provided with a liquid surface level sensing unit configured to sense a liquid surface level change in a reserve tank arranged in a flow channel extending from an ink tank to a recording head.

2. Description of the Related Art

In recent years, the amount of ink consumed per sheet has increased due to demands such as high image quality and wide-format printing, such that the ink in an ink tank of an inkjet recording apparatus often runs out during a recording operation.

In order to solve the problem of running out of ink, an inkjet recording apparatus provided with a reserve tank in an ink flow channel between the ink tank and a recording head is proposed.

For example, in the inkjet recording apparatus illustrated in FIG. 13A, an ink tank 5 is connected to a recording head 1 via a first hollow tube 8, a reserve tank 4, and a supply tube 2. Even when the ink tank 5 is out of ink, the recording operation can be temporarily continued with ink in the reserve tank 4, and the ink tank 5 can be replaced by a new tank while continuing the recording operation (continuous recording).

In an inkjet recording apparatus having such a configuration, the amount of ink in the reserve tank needs to be constantly monitored during the recording operation. When a reduction in the amount of ink in the reserve tank is sensed, it is estimated that the ink tank is empty, and a user is prompted to replace the ink.

The amount of ink in the reserve tank (the amount of ink remaining in the reserve tank) is detected by sensing that the ink surface is below a predetermined position (H) (sensing of the ink surface level). Exemplary embodiments of the liquid surface level sensing unit used for sensing the ink surface level include electrodes (421 and 422) configured to sense a potential difference and an optical sensor using light reflection properties as illustrated in FIG. 13A.

However, air bubbles generated in the ink tank, or air bubbles entering a liquid flow channel during replacing the ink tank may flow into the reserve tank together with a flow of ink. If the air bubbles flow into the reserve tank, the liquid surface level sensing unit may not work correctly, that is, erroneous sensing may occur.

For example, in the case of liquid surface level sensing by using electrodes, an energized state between two electrodes is not released due to air bubbles which have accumulated on the liquid surface, such that a liquid surface level change (lowering) cannot be sensed even though the liquid surface level is lowered.

The same applies to the case of liquid surface level sensing by using an optical sensor. In other words, a light beam is reflected due to the presence of the air bubbles adhering to the surface of a prism of the optical sensor irrespective of the presence or absence of the liquid (ink), such that the liquid surface level change may not be sensed.

As a countermeasure for the erroneous sensing problem due to the air bubbles as described above, a disclosure in Japanese Patent Laid-Open No. 2007-237552 is proposed.

Specifically, according to Japanese Patent Laid-Open No. 2007-237552, an internal space of the reserve tank open to the atmosphere is partitioned into two chambers by a partitioning plate. An ink inlet port is provided on a lower portion of one of the chambers. The partitioning plate is provided with communication ports to make the two chambers communicate with each other at two positions, namely, above and below the ink surface level in order to keep the liquid surface levels in the chambers on both sides of the partitioning plate the same. With the provision of an optical sensor in a chamber different from the chamber provided with the ink inlet port, a method is proposed to prevent erroneous sensing by blocking air bubbles entering through the ink inflow port to keep the air bubbles and the optical sensors out of contact with each other.

If an attempt is made to provide a partitioning plate 41 disclosed in Japanese Patent Laid-Open No. 2007-237552 in the reserve tank 4 illustrated in FIG. 13A, the partitioning plate 41 needs to be provided with communication ports 41A and 41B as illustrated in FIG. 13B.

In a configuration illustrated in FIG. 13B, an ink inflow port 8*a* through which the ink flows from the ink tank 5 to the reserve tank 4 is provided on an upper surface (top surface) of the reserve tank 4. Therefore, when ink flows into the reserve tank 4 up to the upper surface (the reserve tank 4 is filled with ink up to the top), no space remains in which air can exist.

If ink in the ink tank 5 is used up in a state in which the reserve tank 4 is filled with ink to the top surface, air (air bubbles) flows into the reserve tank 4 from the ink tank 5. In other words, air (air bubbles) having the same volume as a volume of the ink which has flowed out from the reserve tank 4 toward a head flows into the reserve tank 4 from the ink tank 5.

In this case, the ink surface level in the reserve tank 4 is lowered. However, a volume (height) of air bubbles which have flowed from the ink tank 5 and accumulated on the liquid surface is increased by an amount not smaller than the amount of lowering of the ink surface level in the chamber provided with the ink inflow port 8*a*. Consequently, as illustrated in FIG. 13B, there is an increased risk (probability) that air bubbles enter the chamber provided with the electrodes (421 and 422), which are liquid surface level sensing units, through the upper communication port 41B and adhere to the electrodes.

Therefore, even though the liquid surface level (the amount of ink remaining in the reserve tank 4) in the reserve tank 4 is lowered, an electricity conducting state between the electrodes (421 and 421) due to the air bubbles which have entered the chamber provided with the electrodes (421 and 422) and accumulated on the liquid surface cannot be resolved. Therefore, there is a probability that lowering of the liquid surface level in the reserve tank cannot be sensed accurately (may be erroneously sensed).

SUMMARY OF THE INVENTION

This disclosure provides an inkjet recording apparatus configured to suppress erroneous sensing of the amount of ink remaining in a tank due to accumulation of air bubbles.

The inkjet recording apparatus comprises a first ink tank for storing ink, a second ink tank for receiving ink supplied from the first tank, a partitioning portion configured to partition the second ink tank to form a first chamber and a second chamber, a first communication port provided in the second ink tank and configured to make the first chamber and the second chamber communicate with each other, a second communication port provided in the second ink tank and configured to make the first chamber and the second chamber communicate with each other, an ink inlet port provided in the first chamber and configured to allow ink to flow from the first ink tank to the second ink tank, and a sensing unit which is provided in the second chamber and configured to sense the amount of ink in the second ink tank, wherein the ink inlet port is provided at a position so that where a height of the ink surface when a minimum amount of ink is in the second ink tank under normal usage is a first height and a height of the ink inlet port is a second height, a volume in the second ink tank above the second height does not become smaller than an amount of ink volume change in the second chamber when the volume of the ink is changed from the first height to the second height, and the second communication port is arranged above the second height.

Further features of the present invention will become apparent from the following description of exemplary embodiments with reference to the attached drawings.

DESCRIPTION OF THE EMBODIMENTS

Exemplary embodiments of this disclosure will be described with reference to attached drawings in detail.

Figure 1:
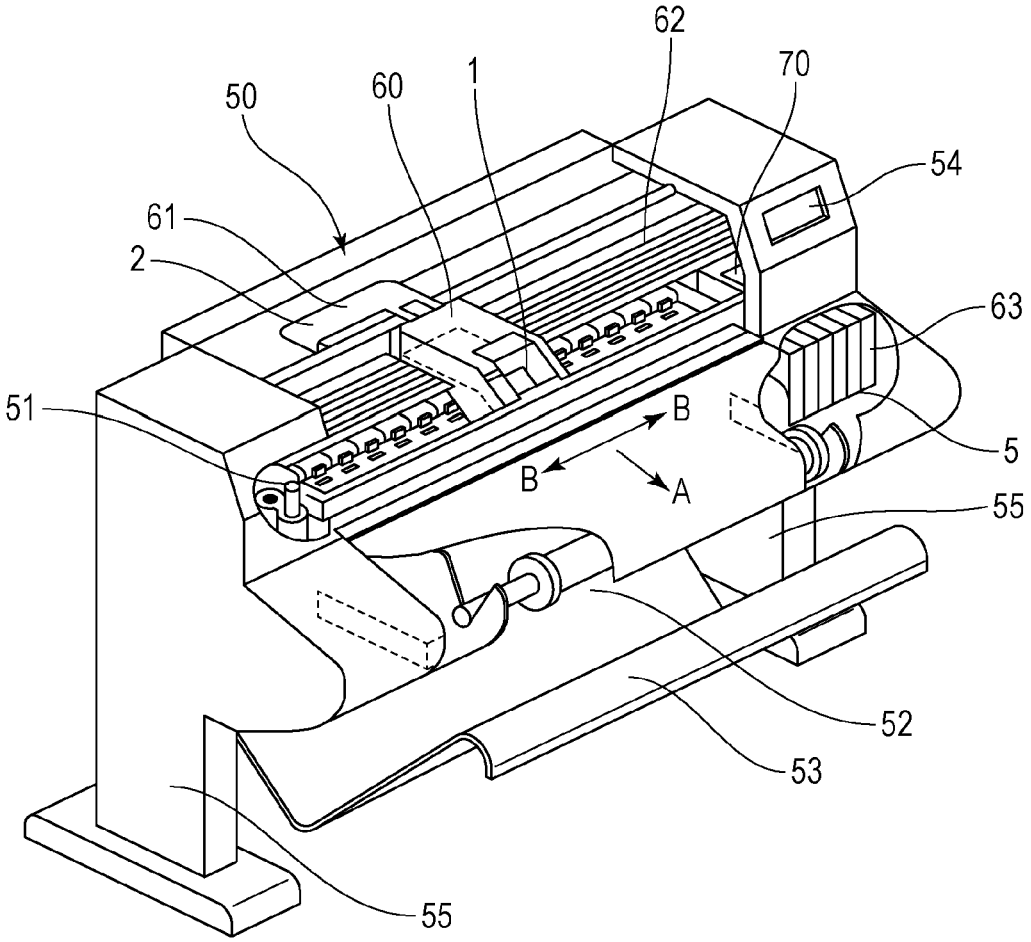
FIG. 1 is a perspective view of an inkjet recording apparatus in an exemplary embodiment of this disclosure.

FIG. 1 is a perspective drawing illustrating an inkjet recording apparatus in the exemplary embodiment of this disclosure. As illustrated in FIG. 1, an inkjet recording apparatus 50 (hereinafter, referred to simply as "recording apparatus") is fixed so as to extend across an upper end portion of two leg portions 55 facing each other.

A head (recording head) 1 is mounted on a carriage 60. During recording, a recording medium set in a conveyance roll holder unit 52 is fed (conveyed) to a printing position.

The carriage 60 is reciprocated in a primary scanning direction B by a carriage motor (not illustrated) and a belt transmission unit 62, and ink droplets are discharged from respective nozzles of the head 1. When the carriage 60 is moved to one end of the recording medium, a conveyance roller 51 conveys the recording medium in a secondary scanning direction A by a predetermined amount.

By repeating the recording operation and the conveying operation alternately in this manner, an image is formed entirely on the recording medium. After the formation of the image, the recording medium is cut with a cutter, which is not illustrated, and the cut recording medium is stacked on a stacker 53.

An ink supply unit 63 includes an ink tank 5 (first ink tank) partitioned and defined according to ink colors such as black, cyan, magenta, yellow, and the like (and configured to be demountably mountable), in which inks in respective colors are stored. The ink tank 5 is connected to a supply tube (ink flow channel) 2 via a reserve tank 4 (second ink tank), which will be described later. The supply tube (ink flow channel) 2 is bound by a tube guide 61 so as to avoid unpredictable movement during the reciprocal movement of the carriage 60.

The head 1 is provided with a plurality of nozzle rows (not illustrated) on a surface facing the recording medium in a direction substantially orthogonal to the primary scanning direction, and each of the nozzle rows is connected to the supply tube (ink flow channel) 2.

A recovery unit 70 is provided at a position outside the range of the recording medium in the primary scanning direction and facing a nozzle surface of the head 1. The recovery unit 70 is provided with a suction unit configured to clean the nozzles by sucking ink or air from surfaces of the discharge nozzles of the head 1 as needed, or forcedly suck air which has accumulated in the interior of the head.

An operation panel 54 is provided on the right side of the recording apparatus 50 and allows the user to input a command to the recording apparatus 50. An alarm is given to prompt the user to replace the ink tank 5 when the ink in the ink tank has been used up.

Figure 2:
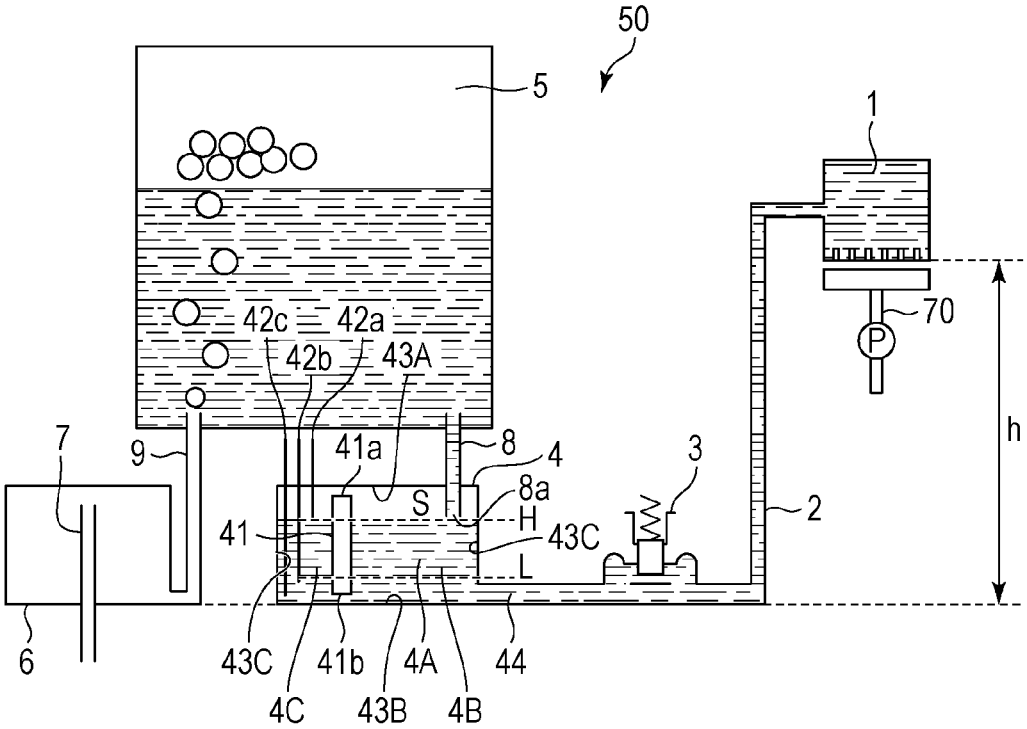
FIG. 2 is a conceptual drawing of an ink flow channel in the exemplary embodiment of this disclosure.

FIG. 2 is a conceptual drawing illustrating an ink flow channel of the inkjet recording apparatus in the exemplary embodiment of this disclosure.

As illustrated in FIG. 2, the recording apparatus 50 in the exemplary embodiment is provided mainly with the ink tank 5 (first ink tank) demountably mounted on an apparatus body (not illustrated) and the reserve tank 4 (second ink tank).

The ink tank 5 is provided with an internal space for storing ink in an interior thereof and two joint portions provided at a bottom portion thereof. One of the two joint portions is coupled to a first hollow tube 8, and the other joint portion is coupled to a second hollow tube 9.

The ink tank 5 communicates with the reserve tank 4 through the first hollow tube 8 and communicates with an atmosphere communication chamber 6 through the second hollow tube 9. In addition, the atmosphere communication chamber 6 is opened to the atmosphere through an atmosphere communication channel 7. In other words, the second hollow tube 9, the atmosphere communication chamber 6, and the atmosphere communication channel 7 constitute an atmosphere opening of the ink tank 5 of this disclosure.

The reserve tank 4 communicates with the recording head 1 through the ink flow channel 2 (supply tube) configured to supply ink. The ink flow channel 2 is provided with an opening-and-closing valve 3 formed of a flexible member which may change the volume and capable of opening and closing the ink flow channel 2. The opening-and-closing valve 3 is driven by a driving mechanism (not illustrated).

Internal Configuration of Reserve Tank

Hereinafter, an internal configuration of the reserve tank 4 in the exemplary embodiment will be described.

In the exemplary embodiment, the reserve tank 4 includes a housing having an upper surface (top surface) 43A, a bottom surface 43B, and a side surface 43C that connects the upper surface 43A and the bottom surface 43B to each other, and that forms an internal space 4A in the housing. In other words, the internal space 4A of the reserve tank 4 is partitioned and defined by the upper surface 43A, the bottom surface 43B, and the side surface 43C. In the exemplary embodiment, the housing of the reserve tank 4 is formed into a rectangular parallelepiped. However, other shapes are also applicable.

In an interior of the reserve tank 4 (housing), a partitioning wall 41 (partitioning portion) arranged so as to be substantially parallel to the side surface 43C is provided, and the internal space 4A is divided into two chambers of a first chamber 4B and a second chamber 4C. The partitioning wall 41 is provided with an opening portion 41*a* (second communication port) on the upper surface side 43A and an opening portion 41*b* (first communication port) on the bottom surface side 43B.

The first chamber 4B and the second chamber 4C communicate with each other through the opening portions 41*a* and 41*b*. Therefore, pressures in the first chamber 4B and the second chamber 4C are harmonized, and as a result the link surface levels in the first chamber 4B and the second chamber 4C are the same.

In the exemplary embodiment, the partitioning wall 41 has a plate shape. However, a meshed plate having a fine texture, or a plurality of ribs are also applicable.

An ink inflow port 8*a* formed of one of opening ends of the first hollow tube 8 and configured to allow ink to flow into the reserve tank 4 is arranged in the first chamber 4B. Specifically, the first hollow tube 8 is provided so as to protrude from the upper surface 43A of the reserve tank 4 into the first chamber 4B, and the ink inflow port 8*a* is arranged below the upper surface 43A of the reserve tank 4.

As described later, by arranging (the location of) the ink inflow port 8*a* below the upper surface 43A of the reserve tank 4, when the liquid surface level in the reserve tank 4 reaches the position of the ink inflow port 8*a*, the ink inflow port 8*a* is sealed by the liquid surface. At this time, a space S in which gas remains is formed between a horizontal surface (liquid surface) including the location of the ink inflow port 8*a* and the upper surface 43A.

In contrast, metallic electrode pins 42*a* to 42*c* (sensing units) configured to sense the amount of ink are arranged in the second chamber 4C. A position of the liquid surface indicated by a broken line H in FIG. 2 (a height position where the ink is sensed to be full) is sensed in accordance with a change in voltage between the electrode pin 42*a* and the electrode pin 42*c* out of the three electrode pins 42*a* to 42*c*. A lower end position of the electrode pin 42*a* corresponds to the level H. A position of the liquid surface indicated by a broken line L in FIG. 2 (a height position where the amount of ink has the minimum volume) is sensed in accordance with a change in voltage between the electrode pin 42*b* and the electrode pin 42*c*. A lower end position of the electrode pin 42*b* corresponds to the level L.

In order to sense the ink surface, a sensor which is capable of sensing the liquid surface level such as the optical sensor may be used instead of a plurality of the electrode pins as in the exemplary embodiment.

In the exemplary embodiment, the ink inflow port 8*a* is positioned below (a lower end of) the opening portion 41*a* of the partitioning wall 41. In other words, (the lower end of) the opening portion 41*a* is arranged above the ink inflow port 8*a*.

Here, "the height at which the amount of ink has the minimum volume (level H)" corresponds to the "first position" of this disclosure. The "height (position) of the ink inflow port 8*a*" corresponds to the "second height" of this disclosure. As described later, the height (position) of the ink inflow port 8*a* is almost the same as the "height at which the ink is sensed to be full (level H) and is slightly higher than the level H. The "height (position of arrangement) of the opening portion 41*a*" corresponds to the "third height" of this disclosure.

In the exemplary embodiment, an ink supply port 44 is arranged on the bottom surface 43B side of the first chamber 4B. Specifically, the ink supply port 44 is arranged in the vicinity of the bottom surface 43B side below the position of the broken line L in FIG. 2. In other words, the ink supply port 44 is arranged below the position of the ink surface level (level L) corresponding to the amount of ink having the minimum possible volume that the electrode pins 42*b* and 42*c* detect. The ink supply port 44 may be provided in the second chamber 4C.

In the exemplary embodiment, the opening portion 41*b* is arranged below the position of the ink surface level (level L) corresponding to the amount of ink having the minimum possible volume that the electrode pins 42*b* and 42*c* detect. In other words, (an upper end of) the opening portion 41*b* is positioned below the level L.

Control Mechanism of Inkjet Recording Apparatus

Figure 3:
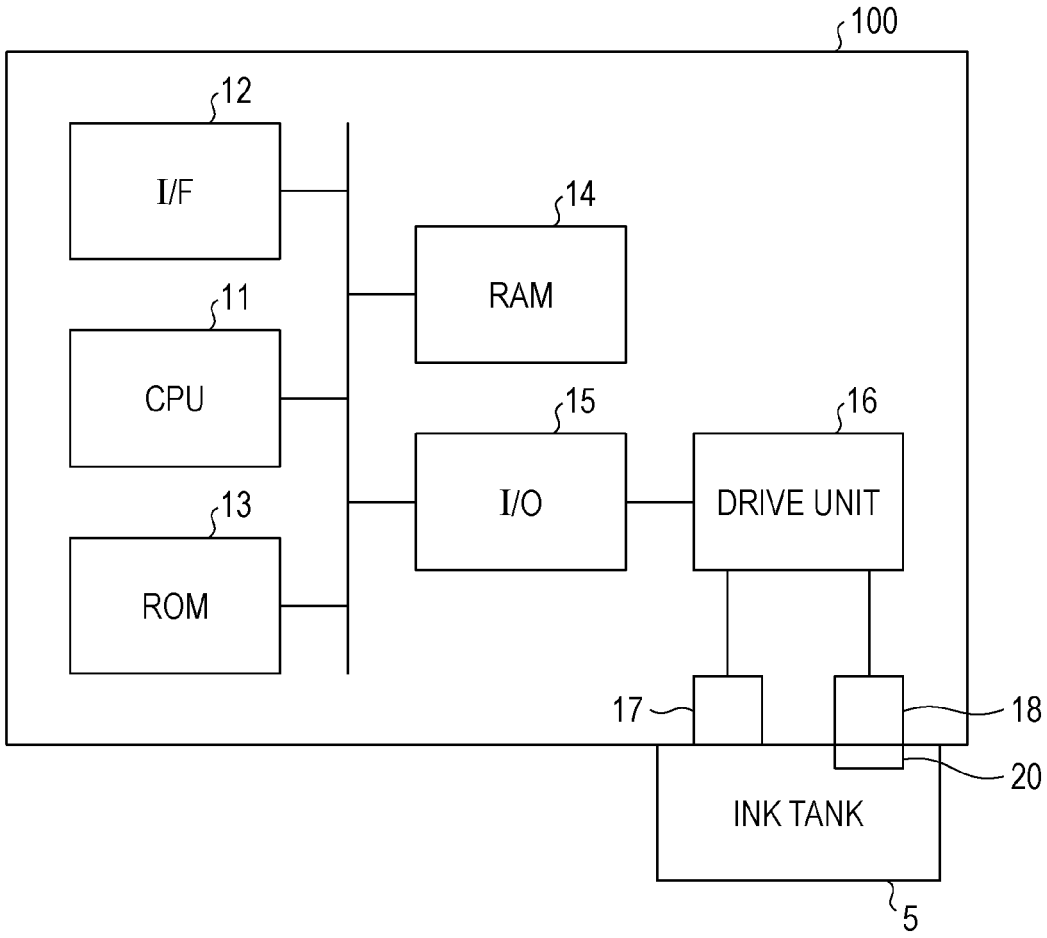
FIG. 3 is a block diagram in the exemplary embodiment of this disclosure.

FIG. 3 is a block diagram illustrating an inner configuration (control mechanism) of the recording apparatus 50 in the exemplary embodiment of this disclosure.

As illustrated in FIG. 3, the recording apparatus 50 in the exemplary embodiment includes a CPU 11 configured to control mainly the recording apparatus, and a user interface 12 having keys that the user operates and an operating panel that displays information. The recording apparatus 50 is provided with a ROM 13 having control software integrated therein, and a RAM 14 configured to be used temporarily when activating the control software. In addition, the recording apparatus 50 is also provided with a I/O drive unit 15, a drive unit 16, an ink remaining amount sensor 17 configured to detect an amount of ink remaining the reserve tank 4, and an ink tank mounting sensor 18 configured to detect mounting and demounting of the ink tank.

The ink remaining amount sensor 17 senses the liquid surface level (remaining amount) in the reserve tank 4 by using voltage values of currents of the electrode pins 42*a*, 42*b*, and 42*c*. The ink remaining amount sensor 17 may have a configuration for sensing the amount of ink remaining in the ink tank 5.

The ink tank mounting sensor 18 determines from a read value of an EEPROM 20 mounted on the ink tank. Reading and writing of the contents of the EEPROM 20 are performed by using the ink tank mounting sensor 18.

Hereinafter, behavior of ink in the reserve tank 4, which is characteristic of the exemplary embodiment, (A) during filling and (B) during continuous recording operation will be described in detail separately.

(A) Ink Behavior in Reserve Tank During Filling with Ink

Referring now to FIG. 4 to FIG. 7B, filling of the reserve tank 4 with ink when the reserve tank 4 is installed in the apparatus body will be described.

Figure 4:
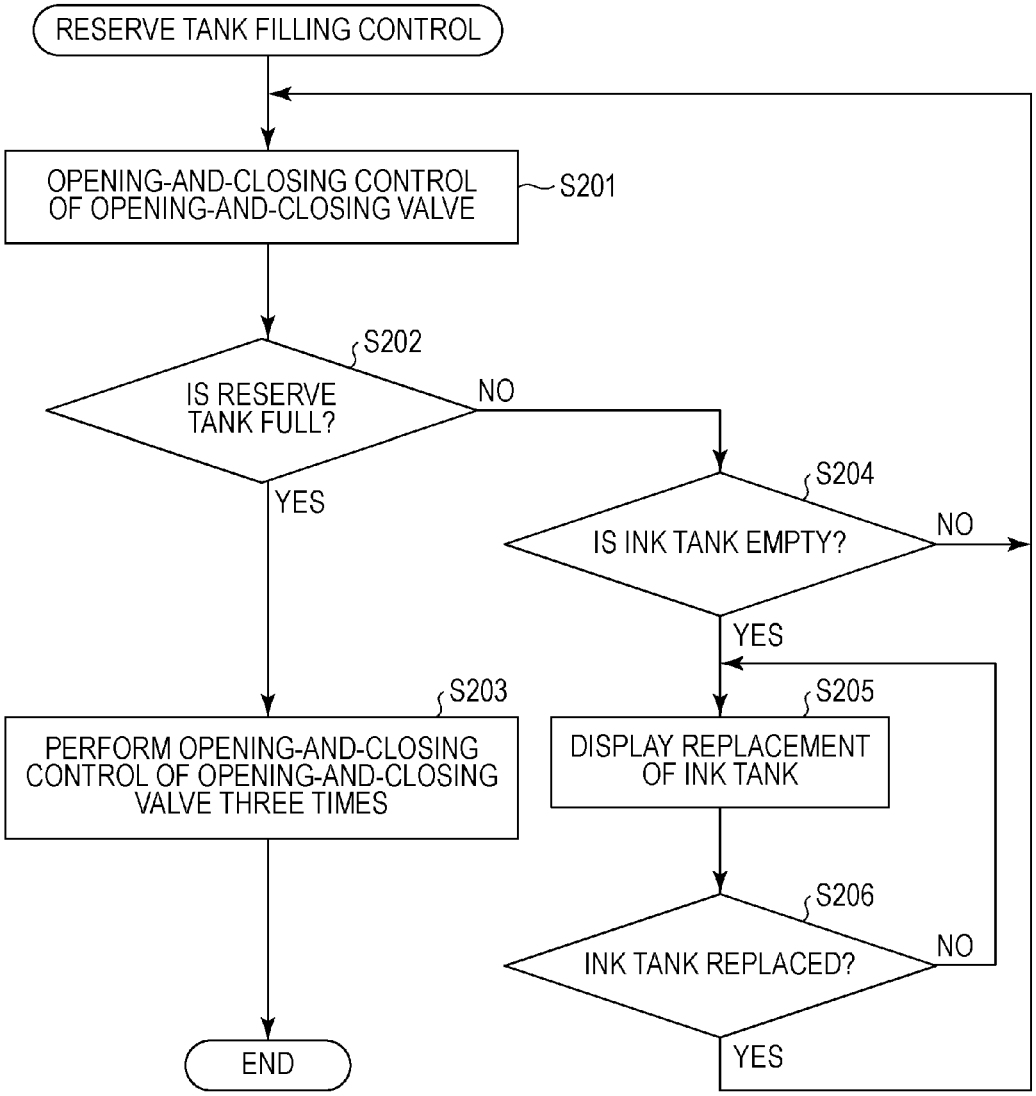
FIG. 4 is a flowchart illustrating a sequence of an action of filling a reserve tank of the inkjet recording apparatus in the exemplary embodiment of this disclosure.

FIG. 4 illustrates a flowchart of a sequence of actions for filling the reserve tank 4 of the recording apparatus 50 in the exemplary embodiment.

Figure 5A:
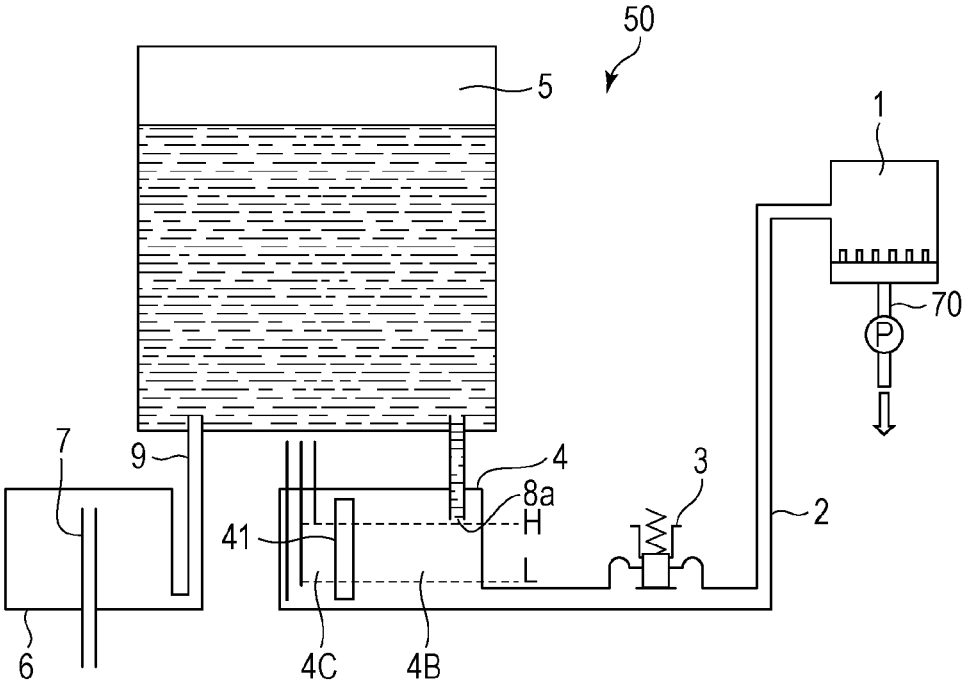
FIG. 5A is a conceptual drawing illustrating a state before a recording head of the inkjet recording apparatus in the exemplary embodiment of this disclosure is filled with ink.
Figure 5B:
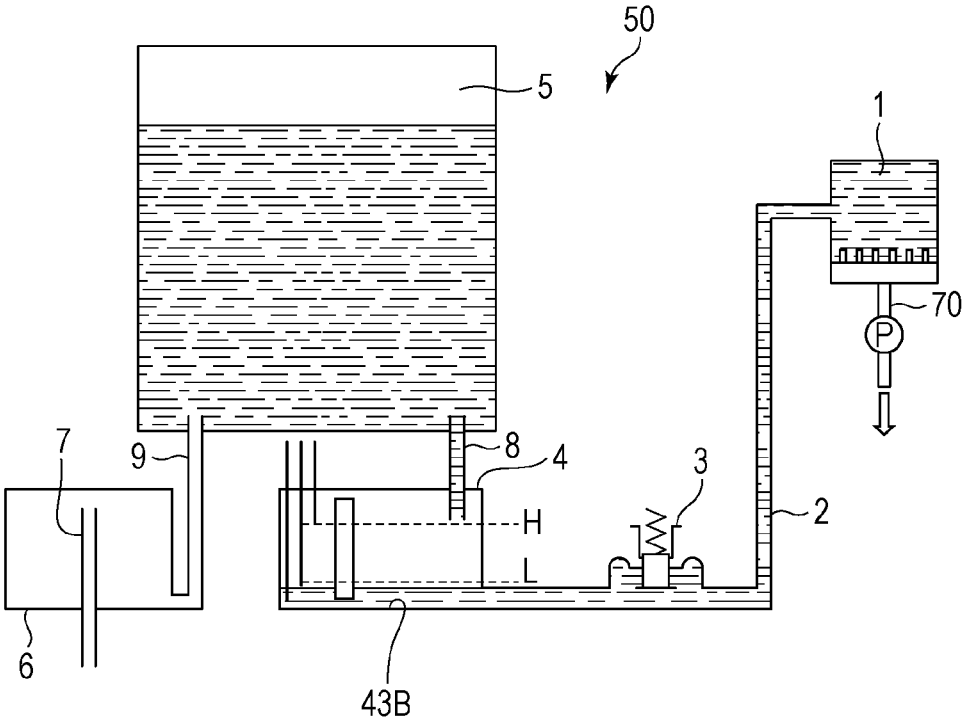
FIG. 5B is a conceptual drawing illustrating a state in which the recording head of the inkjet recording apparatus in the exemplary embodiment of this disclosure is filled with ink.

FIG. 5A illustrates a state before filling the recording head 1 of the recording apparatus 50 with ink. FIG. 5B illustrates a state in which the recording head 1 is filled with ink.

Figure 6A:
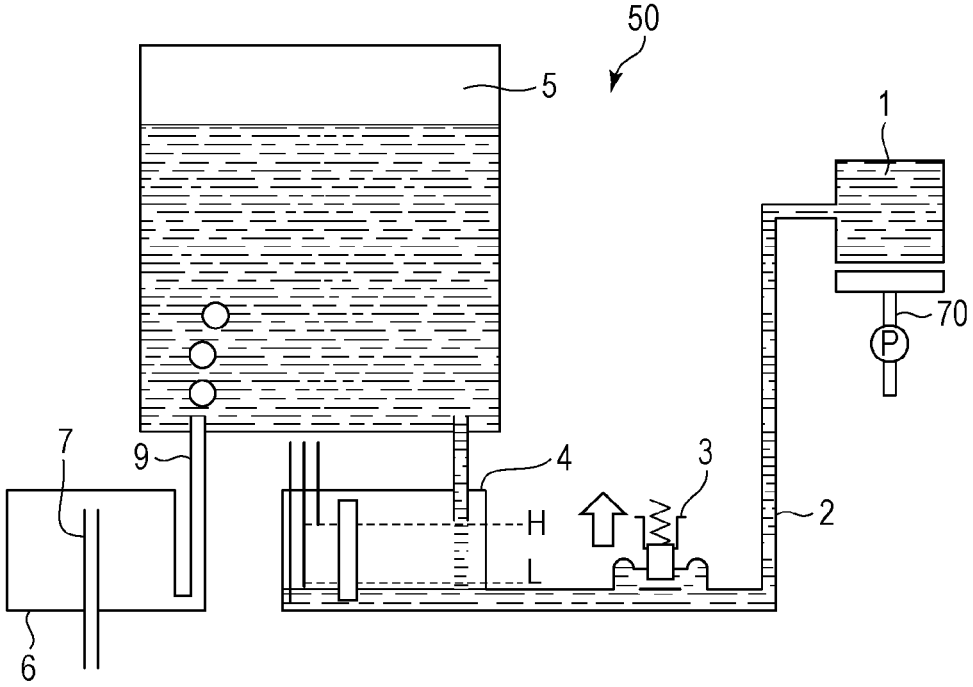
FIG. 6A is a conceptual drawing illustrating a state in which the reserve tank of the inkjet recording apparatus in the exemplary embodiment of this disclosure is started to be filled with ink.

FIG. 6A illustrates a state before filling the reserve tank 4 of the recording apparatus 50 with ink. FIG. 5B illustrates a state of discharging air in the reserve tank 4.

Figure 7A:
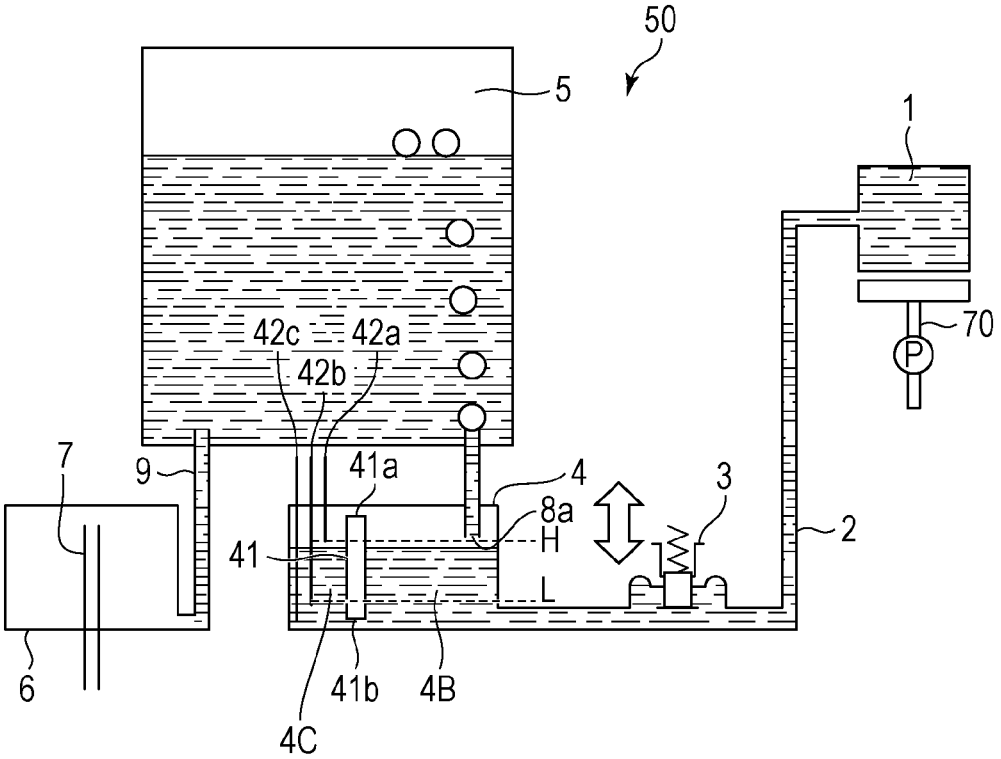
FIG. 7A is a conceptual drawing illustrating an ink filling action in the reserve tank of the inkjet recording apparatus in the exemplary embodiment of this disclosure.
Figure 7B:
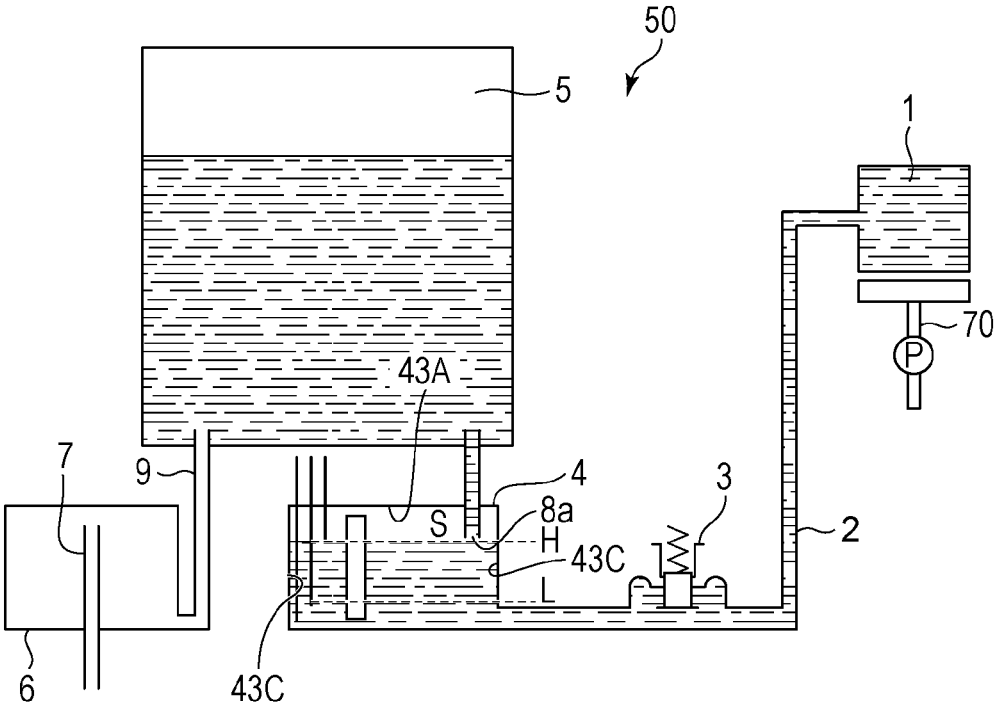
FIG. 7B is a conceptual drawing illustrating a state in which the reserve tank of the inkjet recording apparatus of the exemplary embodiment of this disclosure is completely filled with ink.

FIG. 7A illustrates an action of filling the tank of the recording apparatus 50 with ink. FIG. 7B illustrates a state in which the reserve tank 4 of the recording apparatus 50 is completely filled with ink.

As illustrated in FIG. 5A, when the ink tank 5 is mounted on the apparatus body for the first time, the ink flow channel 2 between the reserve tank 4 and the head 1 is in a state of not yet being filled with ink.

Following this state, the opening-and-closing valve 3 is closed, and the head 1 is sucked by the recovery unit 70 (see FIG. 2) to generate a negative pressure in the ink flow channel from the opening-and-closing valve 3 to the head 1.

Subsequently, when the opening-and-closing valve 3 is opened, the ink is sucked from the ink tank 5 through the reserve tank 4 by the negative pressure so that the ink flow channel 2 from the opening-and-closing valve 3 to the head 1 is filled with ink.

When the ink flow channel filling action is repeated a plurality of times in the same manner, the ink flow channel 2 extending from the opening-and-closing valve 3 through the ink flow channel 2 to the head 1 is filled with ink, and a state in which the reserve tank 4 is filled with a small amount of ink on the bottom surface 43B side is achieved as illustrated in FIG. 5B.

After the state depicted in FIG. 5B is achieved, the reserve tank 4 is filled with ink by a reserve tank filling control action illustrated in FIG. 4.

As illustrated in FIG. 4, when the reserve tank filling control is started, the opening-and-closing valve 3 is controlled to repeat the valve open-and-close action in Step S201.

In the exemplary embodiment, the opening-and-closing valve 3 and the first hollow tube 8 are configured so that a relationship V1>V2 where V1 is a volume of the opening-and-closing valve 3 and V2 is a volume of the first hollow tube 8 is satisfied.

As illustrated in FIG. 6A, when the opening-and-closing valve 3 is switched from the closed state to the opened state, the volume of the opening-and-closing valve 3 is increased, so that ink corresponding to the volume V1 −V2 can be sucked from the ink tank 5 to the reserve tank 4 by an inflow of ink to the opening-and-closing valve 3. The volume at this time is expressed as V3 (=V1−V2). At this time, air corresponding to an amount V3 is sucked from the atmosphere communication chamber 6 into the ink tank 5.

Figure 6B:
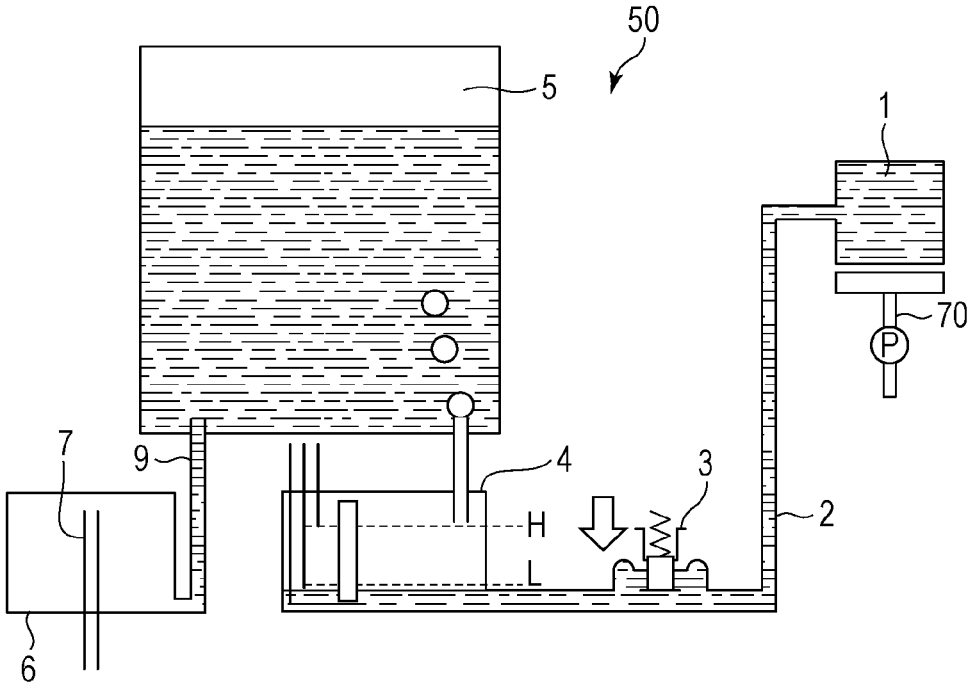
FIG. 6B is a conceptual drawing illustrating a state of discharging air in the reserve tank of the inkjet recording apparatus in the exemplary embodiment of this disclosure.

Subsequently, as illustrated in FIG. 6B, when the opening-and-closing valve 3 is switched from the opened state to the closed state, the volume of the opening-and-closing valve 3 is decreased, so that air that has accumulated in an upper portion of the reserve tank 4 is pushed out from the reserve tank 4 to the ink tank 5 by an amount corresponding to the volume V3. At this time, ink is pushed out from the ink tank 5 to the atmosphere communication chamber 6 by an amount corresponding to the volume V3.

Since a pressure loss in the ink supply channel from the opening-and-closing valve 3 to the head 1 is significantly larger than a pressure loss from the opening-and-closing valve 3 to the ink tank 5, the ink flow between the opening-and-closing valve 3 and the head 1 in response to opening and closing of the opening-and-closing valve (the volume change of the opening-and-closing valve) is low.

In this manner, by repeating the opening-and-closing action of the opening-and-closing valve 3, air in the reserve tank 4 is replaced by ink in the ink tank 5.

As illustrated in FIG. 7A, since the partitioning wall 41 is provided with the two opening portions 41*a* and 41*b*, the liquid surface levels in the first chamber 4B and the second chamber 4C rise in a matched state in association with the replacement of air and ink.

As illustrated in FIG. 4, whether or not the reserve tank 4 is filled with ink is confirmed each time the opening-and-closing action of the opening-and-closing valve 3 is repeated (S202). In other words, the ink surface levels indicated by broken lines H and L in FIG. 7A are sensed by using the electrode pins 42*a* to 42*c*. The ink surface in the reserve tank 4 is sensed to be at the liquid surface level H, and the reserve tank 4 is determined to be full.

The surface of ink supplied from the ink tank 5 to the reserve tank 4 is increased up to the ink inflow port 8*a* by repeating the opening-and-closing action of the opening-and-closing valve 3. If the ink inflow port 8*a* (second height) is sealed by the liquid surface, gas-liquid replacement between the ink tank 5 and the reserve tank 4 is terminated, and inflow of ink into the reserve tank 4 is also stopped. At this time, the amount of ink in the reserve tank 4 becomes the maximum volume under normal usage.

It is recommended to arrange the electrode pin 42*a* (lower end) that senses the ink surface level H to a position slightly lower than that of the ink inflow port 8*a* in order to sense that the liquid level in the reserve tank 4 reliably reaches the level H.

Therefore, as illustrated in FIG. 7A, in the case where the electrode pin 42*a* senses that the ink surface level has reached the liquid surface level H, there remains a small space (distance) between the ink surface level and the position of the ink inflow port 8*a*. Therefore, as illustrated in FIG. 4, the opening-and-closing valve is caused to perform the opening-and-closing action by an additional plurality of times (three times in the exemplary embodiment) (S203) after the reserve tank 4 is sensed (determined) to have been filled with ink (S202). Accordingly, the ink surface may reliably seal the ink inflow port 8*a*.

In the exemplary embodiment, the ink inflow port 8*a* is arranged to a position slightly higher than the ink surface level H (the position at which the ink is determined to be full). However, the position of the ink inflow port 8*a* and the ink surface level H may be the same level. At this time, the control operation in Step S203 may be omitted.

When Step S203 is terminated, as illustrated in FIG. 7B, the ink surface has a position matching that of the ink inflow port 8*a*. In this manner, since the ink inflow port 8*a* protrudes into the interior of the reserve tank 4, the presence of the space S between the ink inflow port 8*a* and the upper surface 43A of the reserve tank 4 is ensured. In other words, the ink inflow port 8*a* is arranged below the upper surface 43A of the reserve tank 4 so that a space (S) in which gas remains is formed between the ink inflow port 8*a* and the upper surface 43A by being surrounded by the upper surface 43A and the side surface 43C.

Even though the recording operation is started after the reserve tank 4 has been completely filled with ink, if there is ink in the ink tank 5, ink is sucked (supplemented) from the ink tank 5 into the reserve tank 4 by an amount corresponding to consumption of ink by the recording operation. Therefore, there is a slight change in the liquid surface level in the reserve tank 4.

In contrast, as illustrated in FIG. 4, in the case where the reserve tank 4 is not filled in S202, the amount of ink remaining in the ink tank 5 is confirmed (S204), and if there is ink remaining in the tank 5, the opening-and-closing action of the opening-and-closing valve 3 is repeated (S201). If it is determined that no ink remains in the ink tank 5, replacement of the ink tank is prompted (S205).

If the ink tank 5 is replaced in S206, the opening-and-closing action of the opening-and-closing valve 3 is repeated (S201). The amount of ink remaining in the ink tank 5 is determined by the remaining amount recorded in the EEPROM 20 of the ink tank 5.

(B) Ink Behavior in Reserve Tank During Continuous Recording Operation

Subsequently, with reference to FIG. 8A to FIG. 10B, ink behavior in the reserve tank 4 during continuous recording for forming an image by using ink in the reserve tank 4 after having used up ink in the ink tank 5 will be described.

Figure 8A:
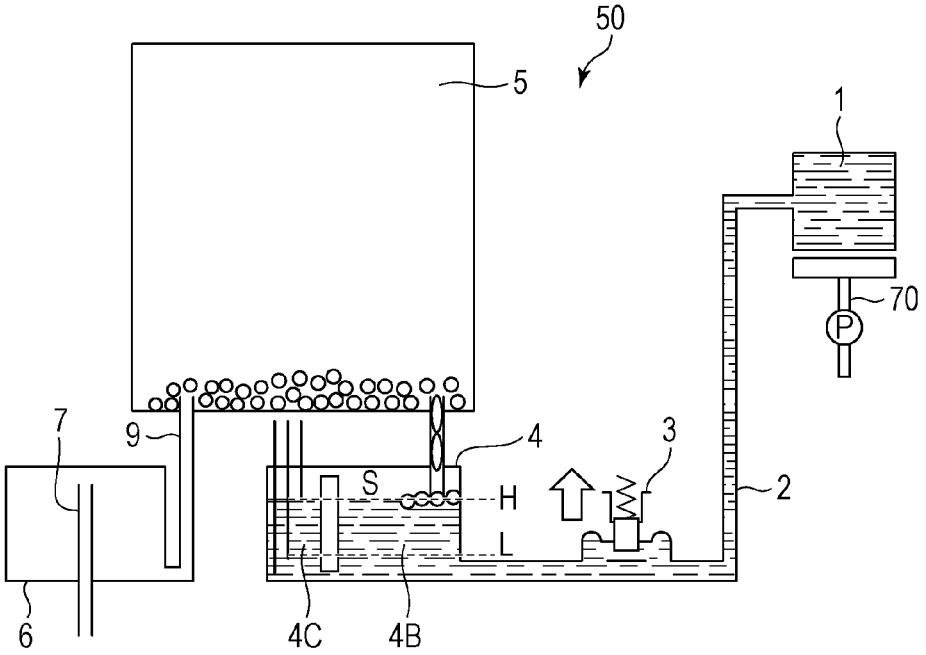
FIG. 8A is a conceptual drawing illustrating a state in which ink in the ink tank is consumed and air bubbles are started to flow into the reserve tank during continuous recording operation of the inkjet recording apparatus in the exemplary embodiment of this disclosure.
Figure 8B:
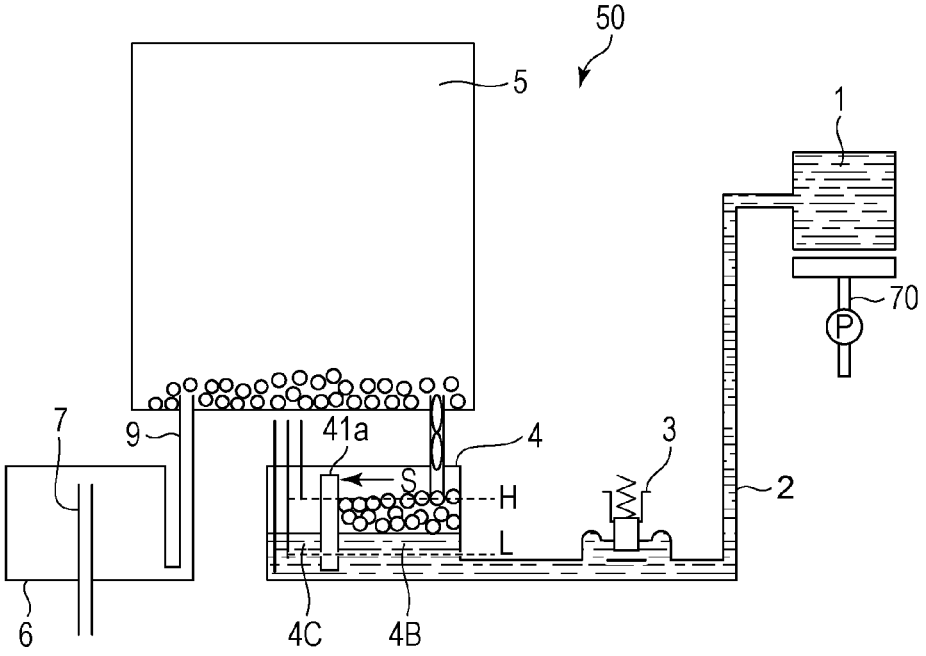
FIG. 8B is a conceptual drawing illustrating a state in which air bubbles are accumulated in the first chamber in association with lowering of the amount of ink in the reserve tank during continuous recording operation of the inkjet recording apparatus in the exemplary embodiment of this disclosure.

FIG. 8A illustrates a state in which ink in the ink tank 5 is consumed and air bubbles start to flow into the reserve tank 4 during a continuous recording operation of the recording apparatus. FIG. 8B illustrates a state in which air bubbles are accumulated in the first chamber 4B in association with a reduction in the amount of ink in the reserve tank 4.

Figure 9A:
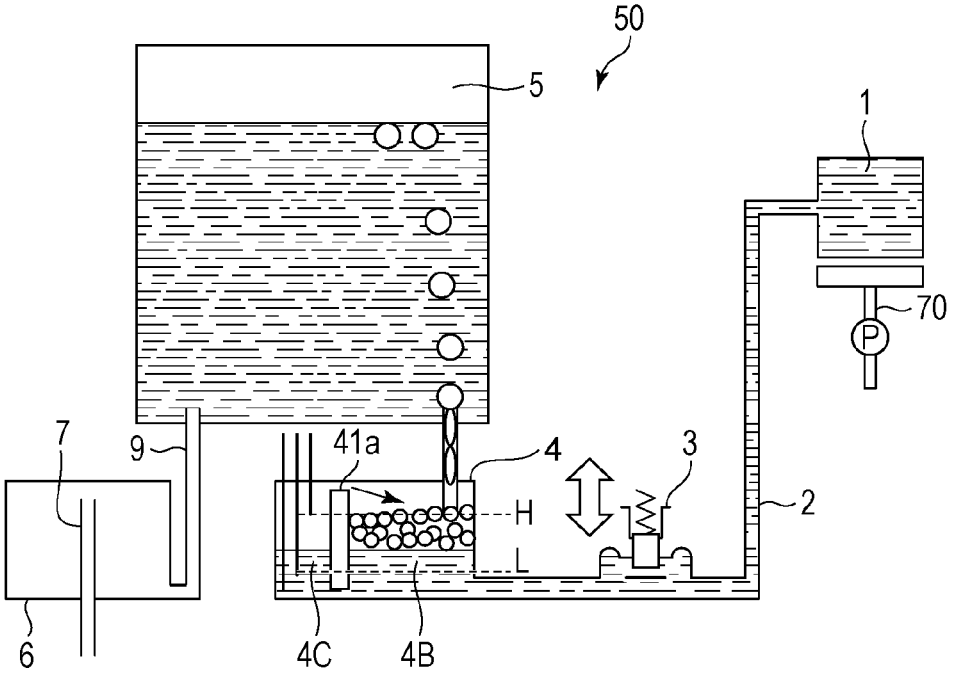
FIG. 9A is a conceptual drawing illustrating an ink filling action in the reserve tank after the ink tank is replaced during continuous recording operation of the inkjet recording apparatus in the exemplary embodiment of this disclosure.
Figure 9B:
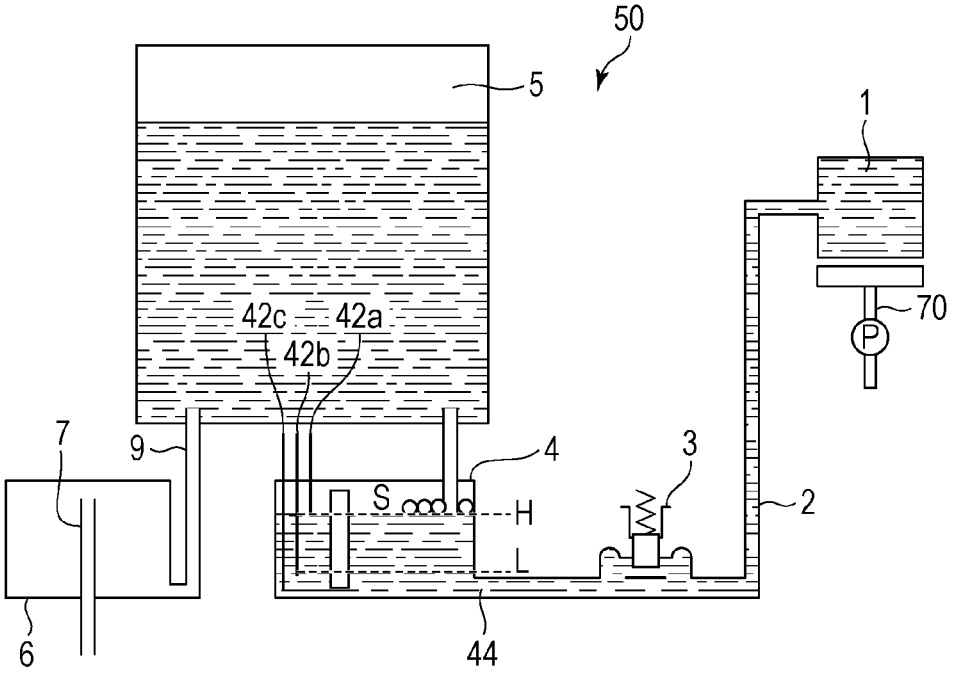
FIG. 9B is a conceptual drawing illustrating a state in which the reserve tank of the inkjet recording apparatus in the exemplary embodiment of this disclosure is completely filled with ink.

FIG. 9A illustrates an ink filling operation in the reserve tank 4 after the ink tank 5 has been replaced during the continuous recording operation of the recording apparatus. FIG. 9B illustrates a state in which the reserve tank is completely filled with ink.

Figure 10A:
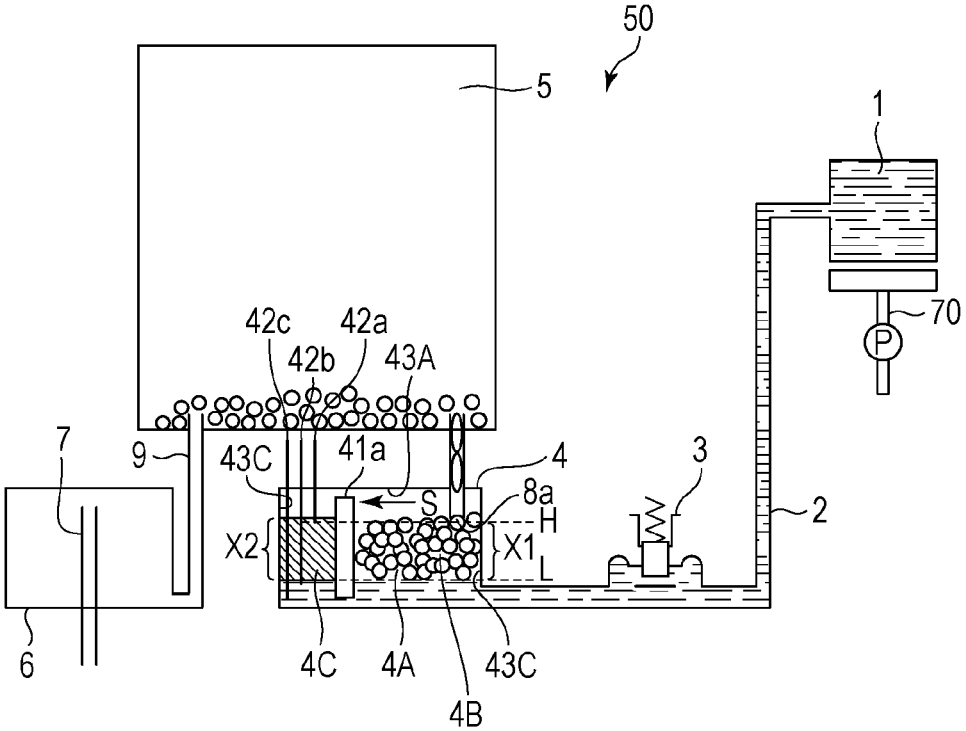
FIG. 10A is a conceptual drawing illustrating a relationship between an amount of ink volume change V and a volume (Vs) of an upper space S in the second chamber during the continuous recording operation of the inkjet recording apparatus in the exemplary embodiment of this disclosure.
Figure 10B:
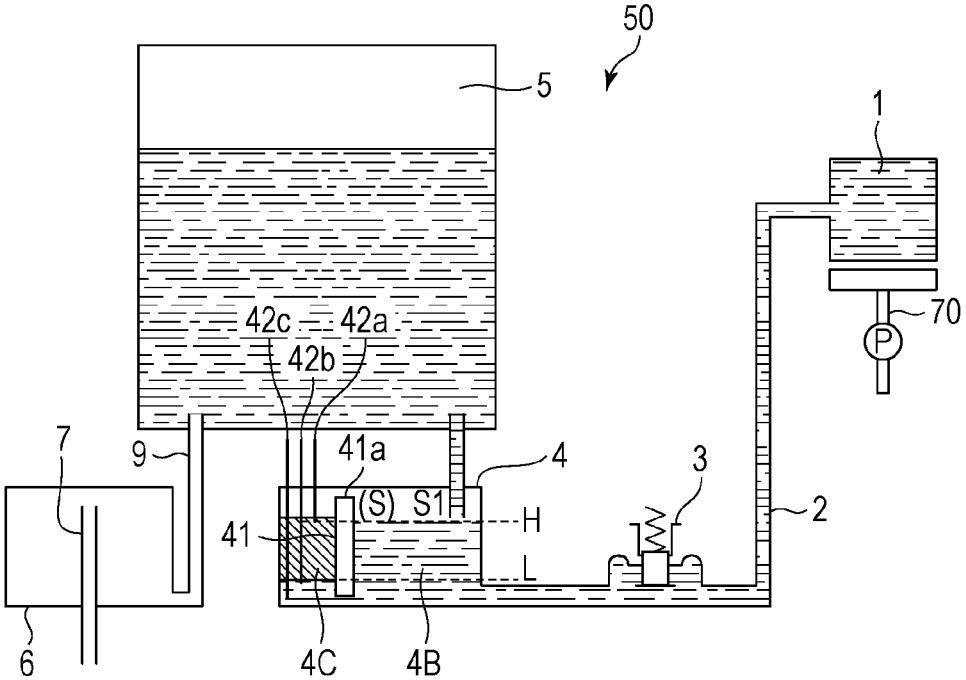
FIG. 10B is a conceptual drawing illustrating a relationship between the amount of ink volume change V and a volume (Vs1) of a space S1 in the first chamber out of the upper space S during the continuous recording operation of the inkjet recording apparatus in the exemplary embodiment of this disclosure.

FIG. 10A illustrates a relationship between an amount of ink volume change V and a volume (Vs) of an upper space S in the second chamber 4C during the continuous recording operation of the recording apparatus. FIG. 10B illustrates a relationship between the amount of ink volume change V of the second chamber 4C and a volume (Vs1) of a space S1 in the first chamber out of the upper space S during the continuous recording operation.

Figure 11:
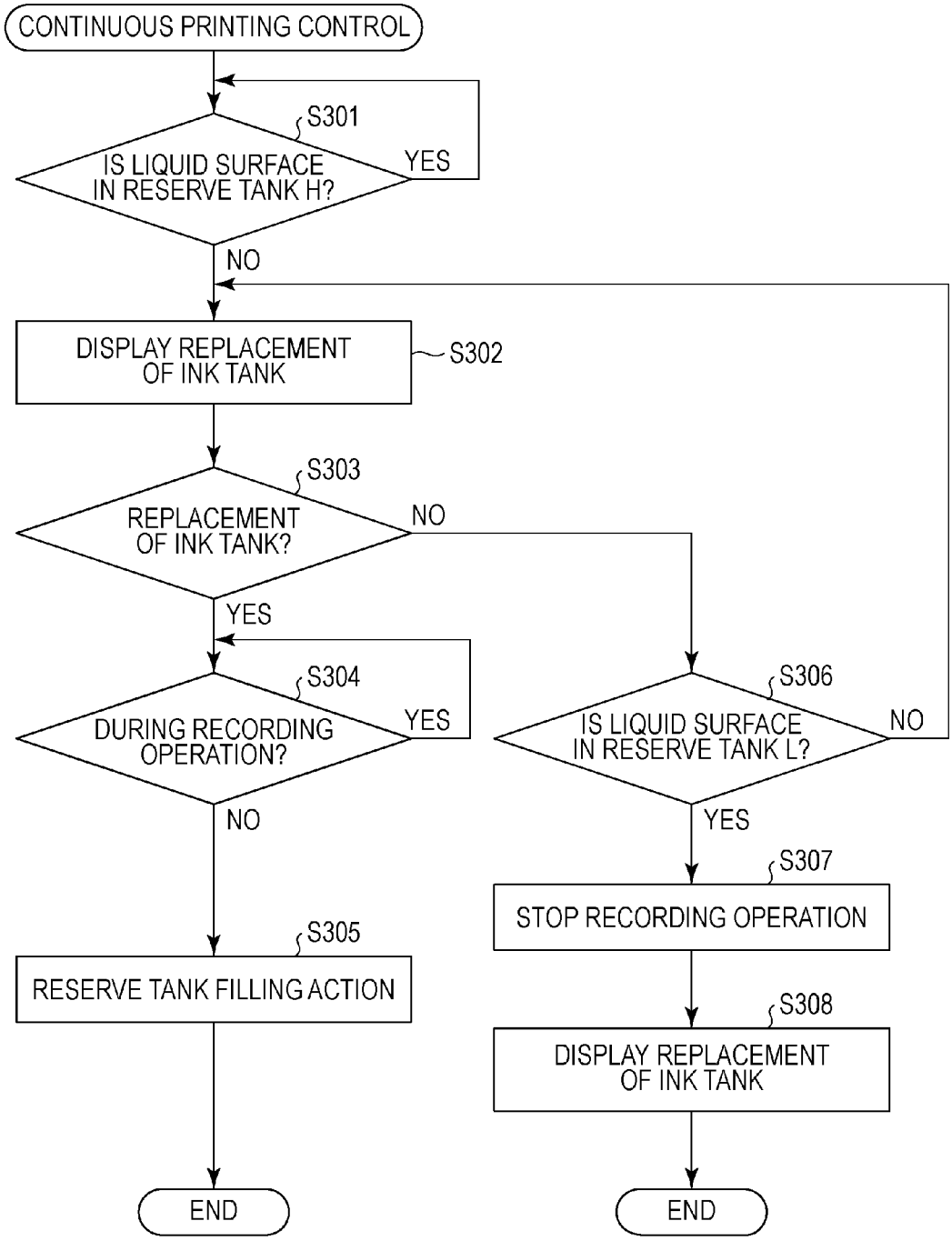
FIG. 11 is a flowchart illustrating a sequence of an action of the continuous recording operation of the inkjet recording apparatus in the exemplary embodiment of this disclosure.

When the ink in the ink tank 5 is consumed and used up, the operation may be switched to the continuous recording operation by using ink stored in the sub tank 4. FIG. 11 is a flowchart illustrating a sequence of the continuous recording operation of the recording apparatus.

As illustrated in FIG. 11, if the operation is switched to the continuous recording operation, determination of whether or not the reserve tank 4 is full is performed (S301). When the ink is consumed and the ink surface drops below the level H (full determination position), a sign encouraging the user to replace the empty ink tank 5 is displayed (an alarm is given) on the operation panel 54 of the apparatus body in S302.

Until the ink tank 5 is replaced, image formation is allowed until the ink surface level in the reserve tank 4 reaches the level L illustrated in FIG. 8A, so that recording may be continued. In other words, the level L is a height corresponding to the minimum ink volume in the reserve tank 4 (first height) under normal usage.

As illustrated in FIG. 8A, if ink in the ink tank 5 is used up, air bubbles in the interior of the ink tank 5 flow into the reserve tank 4 together with air. If the ink tank 5 is not replaced, and the continuous recording operation is continued as-is, a mixture of air bubbles and air of the same amount (the same volume) as the amount of consumed ink flows into the reserve tank 4.

However, as described above, air is present (remains) constantly in the upper space S in the reserve tank 4. Therefore, as illustrated in FIG. 8B, even when air bubbles flow from the ink tank 5 into the first chamber 4B in association with the lowering of the liquid surface level in the reserve tank 4, air bubbles do not flow into the second chamber 4C. In contrast, air present in the space S is allowed to move from the first chamber 4B to the second chamber 4C (see the direction of an arrow) through the opening portion 41*a*. The liquid surface level in the second chamber 4C is flush with the liquid surface level in the first chamber 4B and is lowered in the same manner as the liquid surface level in the first chamber 4B.

Subsequently, as illustrated in FIG. 11, if it is determined that the ink tank 5 has been replaced in Step S303, in 5304, whether or not it is during the recording operation is determined.

In the case where the recording operation is stopped (between pages or after completion of the recording operation), the operation is switched to the reserve tank 4 filling operation in Step S305.

In the reserve tank 4 filling operation, replacement between air bubbles and ink between the reserve tank 4 and the ink tank 5 is performed by the opening-and-closing action of the opening-and-closing valve 3. At this time, as illustrated in FIG. 9A, in association with rising of the liquid surface level in the reserve tank 4, air bubbles in the first chamber 4B return to the ink tank 5, and air in the second chamber 4C moves to an upper space in the first chamber 4B through the opening portion 41*a* (see the direction of an arrow).

As illustrated in FIG. 9B, if the liquid surface level in the reserve tank 4 rises to the level H again, the electrode pins 42*a* and 42*c* sense that the ink in the reserve tank 4 is full (in the same manner as S202). Furthermore, the opening-and-closing valve 3 repeats the opening-and-closing action three times, and the filling operation is terminated (in the same manner as S203). When the filling operation is completed, the reserve tank 4 is restored to a state of being filled with ink and having the upper space S occupied by air.

As illustrated in FIG. 9B, there is the case where a small amount of air bubbles remains in the reserve tank 4 because the replacement between air bubbles and ink is not completely achieved. However, since these air bubbles are broken and disappear within a certain time, the bubbles are naturally eliminated while the ink in the ink tank 5 is consumed, and hence no major problems are caused.

In contrast, as illustrated in FIG. 11, if the ink tank 5 is not replaced in S303, the recording operation (continuous recording) may be continued until the ink surface level in the reserve tank 4 is determined to have reached the level L (the amount of ink having a minimum volume) in S306.

In the case where the ink surface level in the reserve tank 4 reaches the level L, air enters the ink supply channel 2 from the ink supply port 44 unless the recording operation is stopped which causes a discharge failure due to air entering the head 1. Therefore, the recording operation is stopped immediately in S307, and replacement of the ink tank 5 is prompted in S308.

Next, a relationship between a liquid surface level variation in the reserve tank 4 and the volume of the upper space S during the continuous recording operation will be described.

As illustrated in FIG. 10A, if the ink tank 5 is not replaced and ink in the reserve tank 4 is continuously consumed (continuous recording operation) even though the ink tank 5 is empty, the liquid surface level in the reserve tank 4 is lowered. In association with the lowering of the liquid surface level, an area (X1) from the level L to the position of the ink inflow port 8*a* (or the level H) in the first chamber 4B is filled with air bubbles.

In contrast, the liquid surface level in the second chamber 4C varies from the position of the ink inflow port 8*a* (or the level H) to the level L in the same manner. In other words, an area (X2) indicated by a hatched portion in FIG. 10A corresponds to the maximum replaceable volume (amount of ink volume change V) when ink in the second chamber 4C is replaced by air.

With a configuration in which the space S is sufficiently larger than the amount of ink volume change V so that the amount of ink volume change V can be replaced by air in the space S, a problem of inflow of air bubbles from the first chamber 4B to the second chamber 4C (see the direction indicated by an arrow) is alleviated.

In other words, the problem of inflow of air bubbles into the second chamber 4C is alleviated and the problem of erroneous sensing is alleviated by setting the volume (Vs) of the upper space S from the position of the ink inflow port 8*a* with respect to the amount of ink volume change (V) in the second chamber 4C when the ink volume is changed from the level L, which is the height of the ink surface when ink of the minimum volume is in the reserve tank 4 under normal usage, to the position of the ink inflow port 8*a* so as not to be smaller than the amount of ink volume change (that is, Vs≥V).

In this manner, even though ink in the reserve tank 4 is consumed and air bubbles flow into the first chamber 4B during the continuous recording operation, a space for accommodating air bubbles temporarily and the time (space) until the air bubbles disappear may be secured in comparison with the case in the related art where no upper space is present as a result of providing a sufficient volume (Vs) in the upper space S.

In other words, probability of adhesion of air bubbles on the electrode may be reduced and time until the air bubbles are adhered to the electrode (the length of a route of movement of air bubbles) may be secured. Consequently, even though air bubbles in the ink tank 5 flow into the reserve tank 4, the provability of inflow of the air bubbles from the first chamber 4B into the second chamber 4C via the opening portion 41*a* arranged in the space S is alleviated.

Even though air bubbles flow in the second chamber 4C, the probability of adhesion of the air bubbles on the electrode pin (42*a* to 42*c*) is lowered by providing a sufficient volume (Vs) in the space S, so that the problem of erroneous sensing by the adhesion of air bubbles on the electrode pin is alleviated.

As illustrated in FIG. 10B, the volume (Vs1) of a portion of the space S (upper space S1) located in the first chamber 4B may be set to a value not smaller than the amount of ink volume change V (Vs1≥V).

In other words, the ink inflow port 8*a* may be arranged at a position where the volume (Vs1) of the first chamber 4B in the space S above the position of the ink inflow port 8*a* (second height) does not become smaller than the amount of ink volume change (V) (that is, Vs1≥V) with respect to the amount of ink volume change (V) in the second chamber 4C.

Accordingly, even when the liquid surface level in the reserve tank 4 is lowered to the level L and air bubbles of a maximum amount flow from the ink tank 5 into the first chamber 4B, a volume, which is excessive for sure (=Vs1−V), may be remained reliably in the upper space S1 of the first chamber 4B. Therefore, even though a large amount of air bubbles flows into the reserve tank 4, air bubbles may be accumulated sufficiently in the upper space (S1) of the first chamber 4B, so that probability of entry of the air bubbles into the second chamber 4C is alleviated.

If the thickness of the partitioning wall 41 is within a range which can be ignored in comparison with the width of the reserve tank 4, the volume (Vs1) of the upper space S1 in the first chamber 4B may be calculated from the volume (Vs) of the upper space S with a center (surface) of the partitioning wall 41 in the thickness direction as a boundary. In contrast, if the thickness of the partitioning wall 41 cannot be ignored, the volume (Vs1) of the upper space S1 may be calculated on the basis of the distance between the side surface of the partitioning wall 41 to the side surface 43C of the reserve tank 4 facing the same and the bottom surface area of the first chamber 4B.

In addition, the communication port 41*a* (second communication port) can be arranged in the upper space S1 within an area of the space (Vs1−V) remaining above except for the space corresponding to the amount of ink volume change (V) from the position of the ink inflow port 8*a*.

In other words, the communication port 41*a* (second communication port) may be provided at a position where the volume in the first chamber 4B from the ink inflow port 8*a* (second height) to the height (third height) of the communication port 41*a* (second communication port) does not become smaller than the amount of ink volume change (V) with respect to the amount of ink volume change (V) in the second chamber 4C.

Accordingly, in the case where the entire part of a portion corresponding to the volume of the ink flowed out (consumed) from the reserve tank 4 flows from the ink tank 5 into the reserve tank 4 in the form of air bubbles as well, the air bubbles are prevented from entering the second chamber 4C beyond the upper communication port 41*a*. Therefore, inflow of air bubbles from the first chamber 4B to the second chamber 4C may be prevented further effectively. Therefore, preventing erroneous sensing by the adhesion of the air bubbles on the electrode pins (42*a* to 42*c*) is achieved further reliably.

As described thus far, according to this disclosure even though air bubbles flow from the ink tank 5 into the interior of the reserve tank 4 having no atmosphere communication port, inflow of the air bubbles to the second chamber 4C side provided with the sensing unit may be alleviated. Therefore the liquid surface level change in the reserve tank may reliably be sensed.

Others

Figure 12:
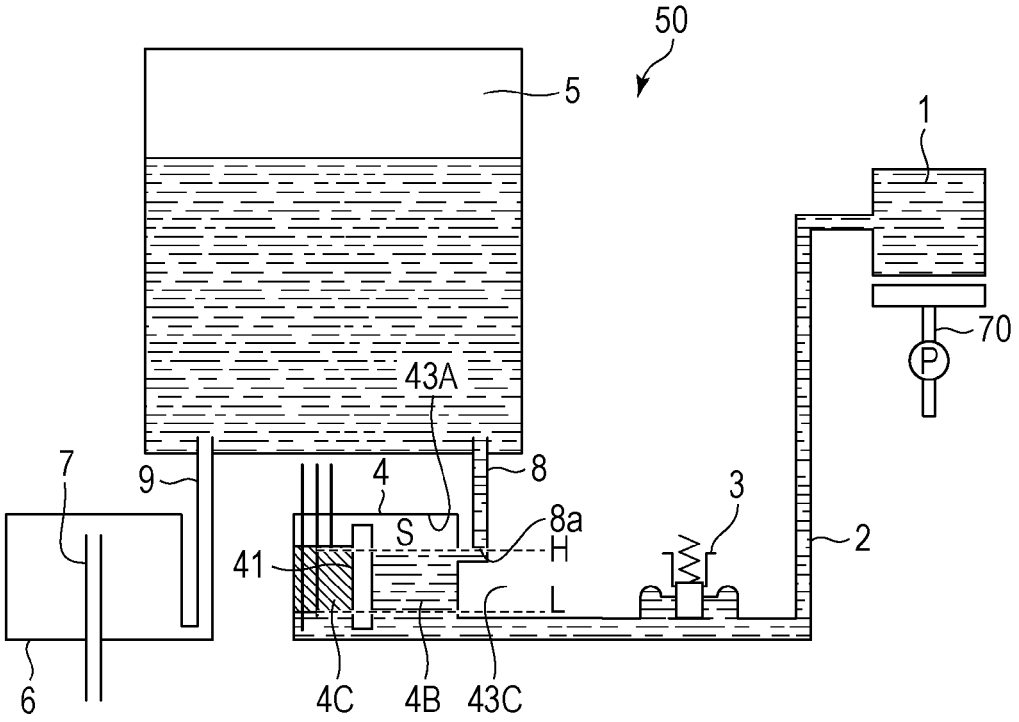
FIG. 12 is a conceptual drawing illustrating a modification of the inkjet recording apparatus in the exemplary embodiment of this disclosure.
Figure 13A:
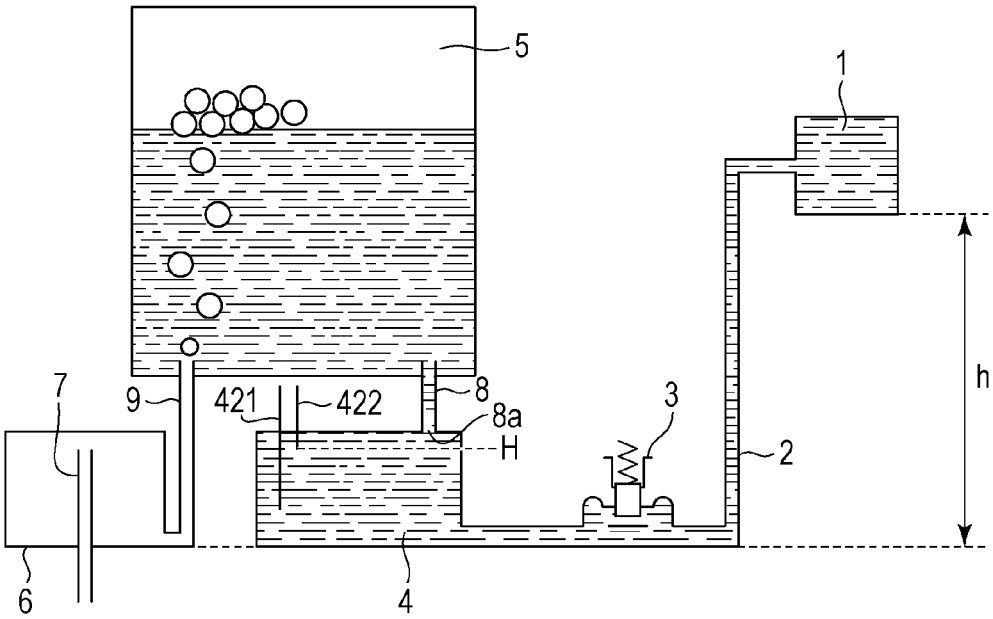
FIG. 13A is a first configuration drawing of an inkjet recording apparatus of the related art.
Figure 13B:
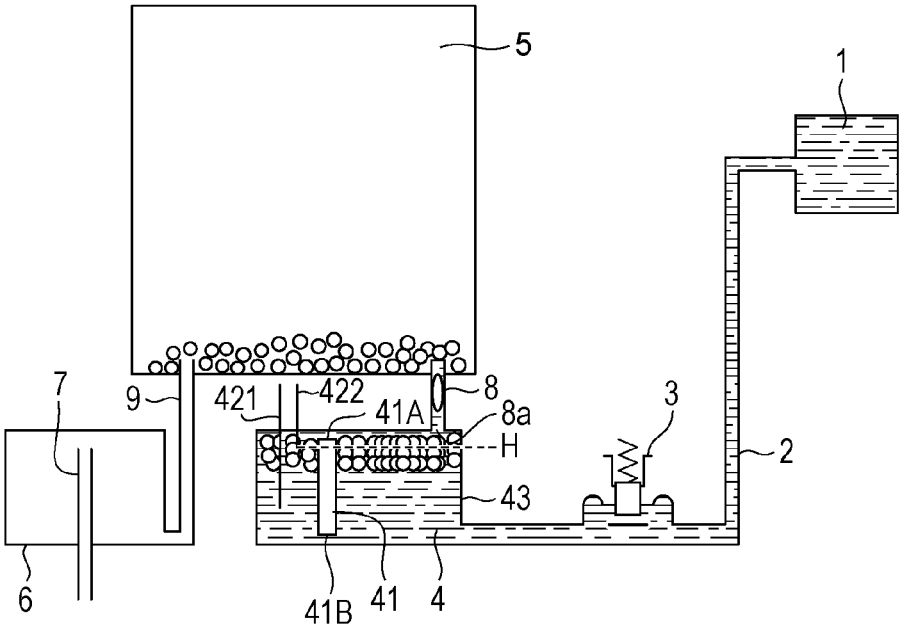
FIG. 13B is a second configuration drawing of the inkjet recording apparatus of the related art.

In the exemplary embodiment described above, a mode in which the ink inflow port 8*a* (first hollow tube 8) is provided so as to protrude downward of the upper surface 43A of the reserve tank has been described. However, the ink inflow port 8*a* may be configured in another form. For example, as illustrated in FIG. 12, the ink inflow port 8*a* may be provided on the side surface 43C. In this case, the ink flows into the reserve tank 4 to the highest position of the ink inflow port 8*a*, and then the ink inflow port 8*a* is sealed by the liquid surface. Therefore, the volume of the space S above the highest position of the ink inflow port 8*a* may be set to be not lower than the amount of ink volume change (V) of the second chamber 4C.

In the exemplary embodiment, the upper surface 43A of the housing of the reserve tank 4 is formed as a flat surface. However, the upper surface 43A may be composed of a plurality of bevels or may be formed of a spherical surface instead of the flat surface. The upper space S having a sufficient volume needs to be provided between the upper surface 43A and the ink inflow port 8*a*.

In the exemplary embodiment, the opening portions 41*a* and 41*b* are provided on the partitioning wall 41. However, the opening portions 41*a* and 41*b* may be provided on the housing of the reserve tank 4. For example, the opening portions 41*a* and 41*b* may be formed of grooves that communicate the first chamber 4B and the second chamber 4C on the upper surface 43A and the bottom surface 43B.

In the exemplary embodiment, the electrode pins (42*a* to 42*c*) as the sensing units are arranged in the second chamber 4C. However, at least part (for example, the electrode pins 42*a* and 42*b*) of the plurality of electrode pins may be arranged in the second chamber 4C, and the remaining electrode pins (for example, the electrode pin 42*c*) may be arranged in the first chamber 4B.

A vertical direction (upper and lower) in this disclosure is determined with reference to a height direction or a direction of gravitational force in a posture of the recording apparatus under the usage.

According to the inkjet recording apparatus of this disclosure, by setting the height of the ink inlet port so as to secure a required volume in the space above the ink inlet port, even though air bubbles flow from the first ink tank to the second ink tank, air bubbles trapped by the first chamber and accumulated on the liquid surface cannot flow from the first chamber into the second chamber easily. Also, the problem of erroneous sensing due to accumulation of air bubbles is alleviated without adhesion of the air bubbles easily to the detecting unit arranged in the second chamber.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-152909, filed Jul. 28, 2014, which is hereby incorporated by reference herein in its entirety.

What is claimed is:

1. An inkjet recording apparatus comprising:

a first ink tank for storing ink;

a second ink tank for receiving ink supplied from the first tank;

a partitioning portion configured to partition the second ink tank to form a first chamber and a second chamber;

a first communication port provided in the second ink tank and configured to make the first chamber and the second chamber communicate with each other;

a second communication port provided in the second ink tank and configured to make the first chamber and the second chamber communicate with each other;

an ink inlet port provided in the first chamber and configured to allow ink to flow from the first ink tank to the second ink tank, and a sensing unit provided in the second chamber and configured to sense the amount of ink in the second ink tank, wherein the ink inlet port is provided at a position such that when a height of the ink surface when a minimum volume of ink is in the second ink tank under normal usage is a first height and a height of the ink inlet port is a second height, a volume in the second ink tank above the second height does not become smaller than an amount of ink volume change in the second chamber when the volume of the ink is changed from the first height to the second height, and the second communication port is arranged above the second height.

2. The inkjet recording apparatus according to claim 1, wherein the ink inlet port is provided at a position where the volume in the first chamber above the second height is not smaller than the amount of ink volume change.

3. The inkjet recording apparatus according to claim 2, wherein where the height of the second communication port is a third height, the second communication port is provided at a position where the volume in the first chamber from the second height to the third height is not smaller than the amount of ink volume change.

4. The inkjet recording apparatus according to claim 1, wherein the first communication port is arranged below the first height.

5. The inkjet recording apparatus according to claim 1, wherein the partitioning portion is formed of a meshed member.

6. The inkjet recording apparatus according to claim 1, wherein the sensing unit includes a plurality of electrodes, and at least one of the plurality of electrodes is arranged in the second chamber.

7. The inkjet recording apparatus according to claim 6, wherein a lower end of the electrode configured to sense the height of the ink surface when the second tank includes a maximum volume of ink is arranged below the second height.

8. The inkjet recording apparatus according to claim 1, wherein the second ink tank is provided with an ink supply port configured to supply ink to a recording head configured to discharge ink, and the ink supply port is arranged below the first position.

9. An inkjet recording apparatus comprising:

a first ink tank for storing ink;

a second ink tank including an upper surface, a bottom surface, and a side surface that connects the upper surface and the bottom surface, and including an ink inlet port configured to allow ink supplied from the first ink tank to flow into an internal space partitioned and defined by the upper surface, the bottom surface, and the side surface;

a partitioning portion configured to partition the internal space of the second ink tank into a first chamber and a second chamber, and including a first communication port configured to enable communication between the first chamber and the second chamber and provided on the bottom surface side, and a second chamber, and a second communication port configured to enable communication between the first chamber and the second chamber and provided on the upper surface side, and a sensing unit provided in the second chamber and configured to sense the amount of ink in the second ink tank, wherein the ink inlet port is arranged below the upper surface in the first chamber so that a volume of a portion partitioned and defined by a horizontal surface including a location of the ink inlet port, the side surface, and the upper surface does not become smaller than an amount of ink volume change in the second chamber when ink in the second ink tank is varied from a minimum volume to a maximum volume under normal usage, and the second communication port is arranged above the ink inlet port.

10. An inkjet recording apparatus comprising:

a recording head;

a first ink tank;

a second ink tank provided in an ink flow channel between the first ink tank and the recording head and configured to store ink therein;

an atmosphere opening port provided in the first ink tank;

an ink inlet port arranged in an interior of the second ink tank and configured to allow inflow of ink from the first ink tank;

an ink supply port configured to supply ink from the second ink tank to the recording head;

a sensing unit configured to sense the amount of ink in the second ink tank;

a partitioning portion configured to partition an internal space of the second ink tank into a first chamber provided with the ink inlet port and a second chamber provided with the sensing unit;

a first communication port provided on the partitioning portion and configured to enable communication between the first chamber and the second chamber at a position below the ink surface when the ink in the second ink tank has a minimum volume; and a second communication port provided on the partitioning portion and configured to enable communication between the first chamber and the second chamber at a position above the ink inlet port, wherein the ink flow channel is arranged at a position not lower than a height of the ink surface when the ink in the second ink tank has a maximum volume under normal usage, and a space having a volume not smaller than the amount of ink volume change in the second chamber when the ink in the second ink tank is varied from the minimum volume to the maximum volume is formed between the ink inlet port and a top surface of the second ink tank.

* * * * *